United States Patent [19]

Mitsak

[11] 4,272,256

[45] Jun. 9, 1981

[54] METHOD FOR HEATING OXYGEN CONTAINING GAS IN CONJUNCTION WITH A GASIFICATION SYSTEM

[75] Inventor: Dimitri M. Mitsak, Edgeworth, Pa.

[73] Assignee: Koppers Company Inc., Pittsburgh, Pa.

[21] Appl. No.: 84,982

[22] Filed: Oct. 15, 1979

[51] Int. Cl.[3] ..... C10J 3/46

[52] U.S. Cl. ..... 48/206; 48/203; 48/DIG. 4; 165/134 R; 165/104.34; 252/373

[58] Field of Search ..... 48/197 R, 202, 206, 48/DIG. 4, 203; 252/373; 165/107 R, 107 D, 134 R

[56] References Cited

U.S. PATENT DOCUMENTS

| | | | |
|---|---|---|---|
| 1,098,534 | 6/1914 | Servais | 48/206 |
| 1,799,885 | 4/1931 | Chavanne | 48/203 |
| 1,913,968 | 6/1933 | Winkler | 48/203 |
| 2,311,140 | 2/1943 | Totzek et al. | 48/203 |
| 2,699,758 | 1/1955 | Dalin | 110/264 |
| 2,919,980 | 1/1960 | Klapp et al. | 48/206 |
| 3,818,869 | 6/1974 | Blaskowski | 48/206 |
| 4,044,820 | 8/1977 | Nobles | 165/107 R |
| 4,137,965 | 2/1979 | Fallen et al. | 165/134 DP |
| 4,184,322 | 1/1980 | Paull et al. | 165/134 R |

FOREIGN PATENT DOCUMENTS

| | | | |
|---|---|---|---|
| 255849 | 12/1926 | United Kingdom | 165/107 R |

*Primary Examiner*—Peter F. Kratz
*Attorney, Agent, or Firm*—Donald M. MacKay

[57] ABSTRACT

A process is provided for the gasification of a carbonaceous fuel to produce a synthesis gas whereby a secondary stream of oxygen is indirectly heated from said synthesis gas and passed to the gasifier to augment the primary oxygen supply.

2 Claims, 1 Drawing Figure

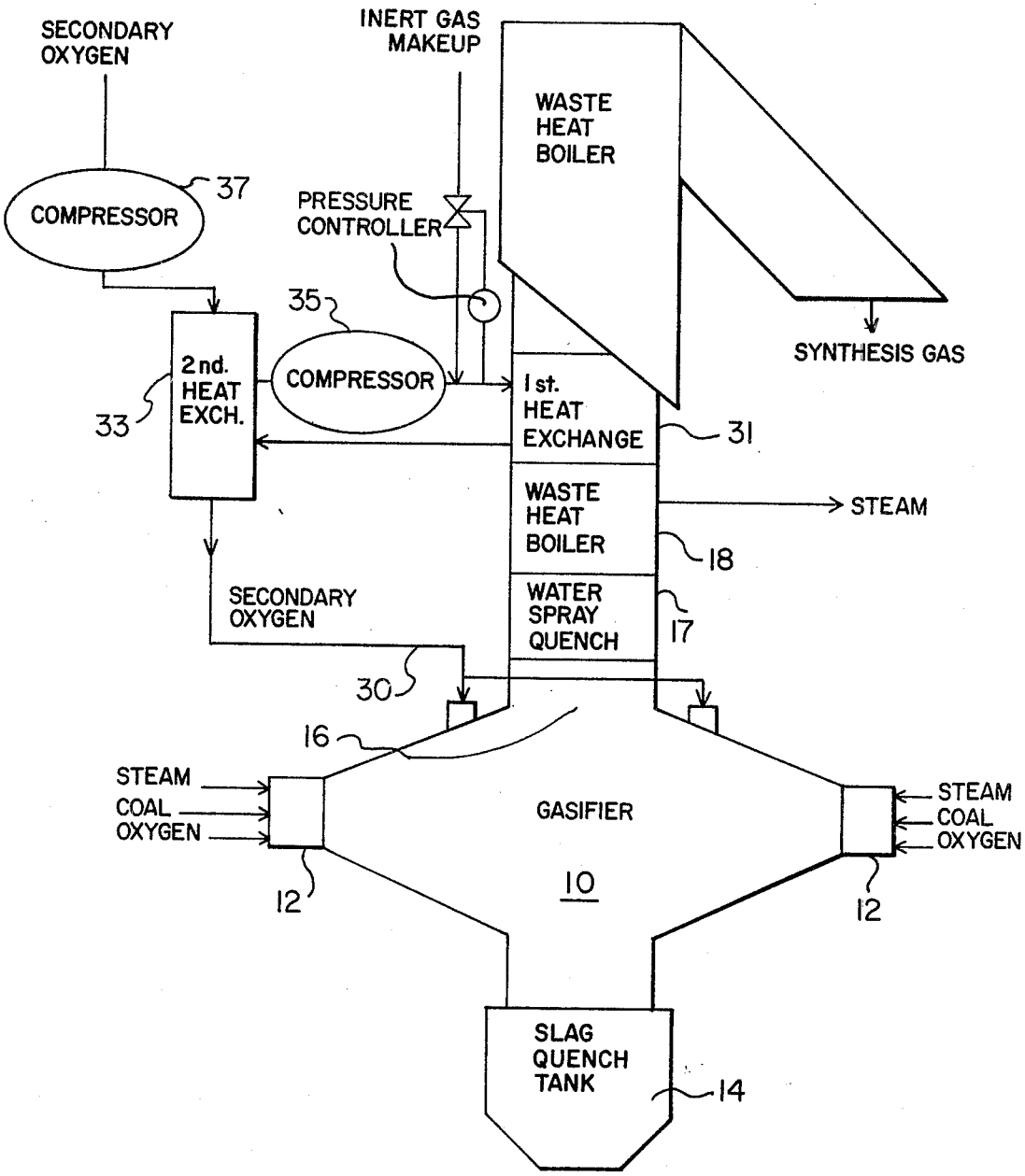
SECONDARY OXYGEN
INERT GAS MAKEUP
WASTE HEAT BOILER
COMPRESSOR
37
PRESSURE CONTROLLER
35
2nd. HEAT EXCH.
COMPRESSOR
1st. HEAT EXCHANGE
31
33
SYNTHESIS GAS
WASTE HEAT BOILER
STEAM
18
SECONDARY OXYGEN
WATER SPRAY QUENCH
17
30
16
STEAM
COAL
OXYGEN
GASIFIER
STEAM
COAL
OXYGEN
12
10
12
SLAG QUENCH TANK
14

METHOD FOR HEATING OXYGEN CONTAINING GAS IN CONJUNCTION WITH A GASIFICATION SYSTEM

BACKGROUND OF THE INVENTION

1. Field of the Invention

This invention relates to the production of a synthesis gas by a reaction of a carbonaceous material with oxygen, oxygen enriched air or air and steam at elevated temperatures.

When oxygen is used in a purity range above 90 volume percent, the synthesis gas is rich in carbon monoxide and hydrogen and is an excellent feed material for the synthesis of various chemicals such as, for example, ammonia, methanol and various hydrocarbons. On the other hand, if air or oxygen enriched air is used then the synthesis gas is dilluted with nitrogen contained in the air and the synthesis gas becomes a fuel gas.

2. Prior Practice

A number of processes, for example, the Koppers-Totzek Process produce synthesis gases from carbonaceous material. A typical process involves the gasification of coal by the reaction of coal with oxygen and water vapor at elevated temperatures. The resulting gas generally consists of two predominant components; carbon monoxide and hydrogen. The ratio which these two components bear to each other depends upon factors such as the gasification process employed, the kind of carbonaceous material, and the relative ratios of the coal and oxygen and steam used. Attempts are made to adjust the ratio of these constituents in the resulting gas to the ultimate desired for the particular use to be made of the gas.

In the coal gasification process, as exemplified for example by the Koppers-Totzek Process, a mixture of the finely pulverized fuel, steam and oxygen is fed into the reactor where, at a high temperature, the reaction of the ingredients of the mixture is almost instantaneous to produce the gas. The gas discharges from the top and most of the ash from the coal becomes a fluid slag and flows from the bottom of the reactor. Although the reaction from the ultimate standpoint appears simple and to take place almost instantaneously, it is postulated that two reactions take place. Some of the carbon of the coal reacts exothermically with the oxygen to provide the quality of heat to raise the temperature of the reacting mass to such a degree that the rest of the carbon can be reacted endothermically with the steam to produce carbon monoxide and hydrogen. The ratios of the fuel, oxygen and steam to be used can be varied to an extent to obtain a desired final gas composition, but it is appreciated that inasmuch as these are fed together as a mixture into the reactor it is difficult to change the individual constituents to any great degree. If a less pure oxygen such as oxygen-enriched air or air alone be used, the accompanying inert nitrogen dilutes the reaction mass. The presence of the diluent uses considerable amounts of energy, tending to consume more coal in bringing the reaction mass to the reaction temperature and dilute the final gas composition as far as such may be reflected in its Btu content or usable constituents such as the carbon monoxide and hydrogen. If either oxygen stream were preheated wtih gasifier hot synthesis gas then the coal usage would be lowered and the gasifier synthesis gas quality would be improved as regards to the production of carbon monoxide and hydrogen because the carbon dioxide level would be reduced since a lower quantity of exothermic heat would be required for the reaction.

SUMMARY OF THE INVENTION

This invention provides a novel apparatus and process for providing a heated supply of secondary oxygen, defined here as oxygen, oxygen enriched air or air, to the reaction so that the flame temperature of the gasifier can remain at a desired level yet enable the operating parameters of the reactor to be changed to a greater degree.

DESCRIPTION OF THE DRAWING

The accompanying drawing is a partially schematic flow diagram with appropriate descriptive legends of the process of the invention.

DESCRIPTION OF THE INVENTION

For purposes of simplicity of description, the embodiment of the invention illustrated herein is shown in conjunction with a conventional Koppers-Totzek Process apparatus. Referring now to the drawing, at each end of a generally cylindrical gasifier 10 is a burner 12 through which a mixture or entrainment of finely ground particles of coal, steam and oxygen feeds into the gasifier. The mixture of steam, gas and oxygen reacts in the gasifier at a high temperature to produce a gas that is predominantly carbon monoxide and hydrogen. Part of the ash from the coal melts as a slag and flows down the walls of the gasifier to a slag disposal unit 14 where it is cooled in water and removed. The rest of the ash remains entrained as fly ash in the gas and exits at 16. A quench area 17 sprays water into the gas to cool the fly ash to a temperature below its ash fusion point so that it will not stick to the surface of the following heat exchangers. The gas then passes through a waste heat boiler 18 for production of usable steam. The gas then flows on to a cleaner (not shown) where various undesirable constituents are removed from the gas.

The foregoing has described the operation of a conventional Koppers-Totzek gasifier. The changes that can be made in the amounts of steam, oxygen and coal are limited. In accordance with this invention, secondary oxygen, defined as either pure oxygen, oxygen-enriched air, or air, may be fed into the reactor through line 30. The secondary oxygen is supplied to the gasifier at a temperature as near to the temperature of the reaction mass within the gasifier, thereby enabling the reaction in the gasifier to be controlled to a greater extent than has been possible heretofore.

To bring the secondary oxygen to an elevated temperature, there is provided a system comprised of a first heat exchanger 31 in the outlet of the gasifier and a second heat exchanger 33 in the inlet of the secondary oxygen to the gasifier 10. Thus, the heat of the gas leaving the gasifier is used to heat the secondary oxygen entering the gasifier.

Oxygen in the synthesis gas stream at gasifier exit brings a risk of explosion. To enable heat exchange to take place with a minimum of danger of explosion, the heat transfer medium for heat exchangers 31 and 33 is an inert gas such as carbon dioxide, nitrogen, or the like. The heat transfer medium can be any gas that does not result in an explosive mixture when added to the synthesis gas being produced. For purposes of example the discussion here will be limited to the inert gas carbon dioxide. A compressor 35 circulates the inert gas through these heat exchangers at a pressure greater than the pressure of the secondary oxygen stream. Thus, as the inert gas flows through heat exchanger 31, it picks up heat developed during the gasification; and, as it flows through heat exchanger 33, it transfers this heat to the incoming secondary oxygen. A compressor 37 forces the secondary oxygen through the heat exchanger 33 and into the gasifier 10.

In a typical operation in accordance with this invention, gasifier 10 will gasify coal at the rate of about 400 tons of coal per day. The coal is dried and pulverized to the extent that about 70 percent will pass through a 200 mesh screen. At the burners 12 a mixture of oxygen and steam or steam alone entraining the coal is projected into the reactor 10 at velocities above the speed of flame propagation to prevent flashbacks into the burner and fuel line. Additional oxygen to gasifier is introduced into the gasifier through secondary oxygen distributor, line 30.

The exothermic oxidation of the carbon tends to produce a flame temperature of around 3500° F., but the endothermic reaction of the carbon with the steam tends to reduce the temperature to about 2700° F., at which temperature the synthesis gas (predominantly carbon monoxide and hydrogen) leaves the gasifier.

Over half of the ash of the coal flows down the walls of the gasifier as slag and drains into a slag quench tank 14. The rest of the ash leaves the gasifier as fly ash entrained in the gas. Water sprays at quench area 17 reduce the gas temperature to about 2000° F., i.e., below the ash fusion temperature, so that the droplets of entrained ash are solidified to suppress the tendency to adhere to heat exchange surfaces.

The synthesis gas then flows past the radiant tubes 18 of a steam boiler and leave this section at a temperature of about 1800° F. This gas passes through the first heat exchanger 31. The carbon dioxide or other selected gas flowing through the heat exchanger 31 absorbs heat from this synthesis gas, the carbon dioxide enters the heat exchanger at a temperature of about 600° F. and leaves at a temperature of about 1600° F. This hot carbon dioxide gas then flows to the second heat exchanger 33 where it exchanges heat with the entering secondary oxygen gas. The secondary oxygen leaves the second heat exchanger 33 at a temperature of about 1400° F. and is injected into the gasifier 10.

In accordance with this invention, the inert heat transfer medium, the carbon dioxide, or other selected gas at the inlet of the first heat exchanger 31 is at a pressure of about 105 pounds per square inch gage, and at the inlet of the second heat exchanger 33 is at a pressure of about 80 pounds per square inch gage. The secondary oxygen enters the second heat exchanger 33 at a pressure of about 45 pounds per inch gage and leaves at a pressure of about 25 pounds per square inch gage. Thus, the pressure of the inert heat transfer gas is at all times higher than the pressures of the secondary oxygen to prevent flow of oxygen into the gasifier synthesis gas stream of the gasifier in the event of a leak in the oxygen side of the heat exchanger system. Should a leak in the oxygen side occur, a suitable pressure control monitor is provided in the inert gas make up system to be activated to maintain inert gas pressure and record the inert gas make up rate. Such instrument would also alert an alarm so that procedures to correct the leaking situation could be initiated.

In accordance with the invention, the secondary oxygen entering the reactor can be changed widely with respect to the fuel and steam so as to enable a wide range of conditions of temperature, and the like, to be achieved in the gasifier to take care of different feed stocks involving, for example, different ash contents and types. Thus, with coal having a high ash fusion point, additional oxygen may readily be added to the reactor to keep the flame temperature at a high level to keep the ash in a molten slag condition. Since the secondary oxygen is at an elevated temperature, near to the reactor temperature, additional secondary oxygen can be added to the reactor without depressing the flame temperature in the reactor.

This invention therefore provides a novel apparatus and process for heating secondary oxygen so that the temperature in the gasifier remains at a level such that the carbon and steam will react. This enables the gasifier to operate at maximum flexibility.

What is claimed:

1. A process for the gasification of a carbonaceous fuel comprising:

(a) feeding a mixture of primary oxygen, steam and fuel to a reaction zone to produce a synthesis gas from said mixture;

(b) heating secondary oxygen indirectly from said synthesis gas wherein said step of heating said secondary oxygen includes removing heat from said synthesis gas in a first heat exchanger by heat exchange with a heat transfer gas which does not form an explosive mixture with the synthesis gas, and transferring the heat from the heat transfer gas to said secondary oxygen in a second heat exchanger and circulating the heat transfer gas between said first and second heat exchangers at a pressure which is at all times greater than the pressure of the secondary oxygen to prevent flow of secondary oxygen into the synthesis gas in the event of a leak in the second heat exchanger; and (c) feeding said secondary oxygen to said reaction zone.

2. The process of claim 1 wherein the heat transfer gas used to remove heat from the synthesis gas is carbon dioxide.

* * * * *